US009000281B2

(12) United States Patent
Fandrich

(10) Patent No.: US 9,000,281 B2
(45) Date of Patent: Apr. 7, 2015

(54) ENHANCED VERTICAL PIANO ACTION SYSTEM AND METHOD

(71) Applicant: Darrell Gerard Fandrich, Stanwood, WA (US)

(72) Inventor: Darrell Gerard Fandrich, Stanwood, WA (US)

( * ) Notice: Subject to any disclaimer, the term of this patent is extended or adjusted under 35 U.S.C. 154(b) by 0 days.

(21) Appl. No.: 13/937,892

(22) Filed: Jul. 9, 2013

(65) Prior Publication Data

US 2014/0013922 A1 Jan. 16, 2014

Related U.S. Application Data

(60) Provisional application No. 61/669,835, filed on Jul. 10, 2012.

(51) Int. Cl.
*G10C 3/18* (2006.01)
*G10C 3/16* (2006.01)

(52) U.S. Cl.
CPC ..... *G10C 3/161* (2013.01)

(58) Field of Classification Search
CPC ..... G10D 3/161
USPC ..... 84/241, 242
See application file for complete search history.

(56) References Cited

U.S. PATENT DOCUMENTS 199,687 A * 1/1878 Brinsmead ..... 84/241
233,103 A * 10/1880 Kranich et al. ..... 84/241
251,348 A * 12/1881 Bullard ..... 84/241
304,777 A * 9/1884 Becker ..... 84/241
334,511 A * 1/1886 Bullard ..... 84/242
381,129 A * 4/1888 Harcourt ..... 84/241
482,740 A * 9/1892 Hicks ..... 84/241
587,543 A * 8/1897 Becker ..... 84/242
594,476 A * 11/1897 Kidd ..... 84/242
666,982 A * 1/1901 Soper ..... 84/241
682,616 A * 9/1901 Herrburger ..... 84/241
687,606 A * 11/1901 Darley ..... 84/241
719,690 A * 2/1903 Perry ..... 84/241
788,482 A * 4/1905 Lingsoh ..... 84/242
849,278 A * 4/1907 Soper ..... 84/241
854,058 A * 5/1907 Sauter ..... 84/241
896,763 A * 8/1908 Schimmel ..... 84/240
924,394 A * 6/1909 Soper ..... 84/241
979,729 A * 12/1910 Wrozina ..... 84/241
992,528 A * 5/1911 Wrozina ..... 84/241
1,000,762 A * 8/1911 Soper ..... 84/241
1,016,408 A * 2/1912 Hicks ..... 84/241
1,094,421 A * 4/1914 Bjorkland ..... 84/241
1,301,908 A * 4/1919 Clutsam ..... 84/240

(Continued)

*Primary Examiner* — Robert W Horn
(74) *Attorney, Agent, or Firm* — Grandview Law PLLC; Brian L. Johnson

(57) ABSTRACT

Systems and methods are involved with but are not limited to: a vertical piano action including: a substantially vertically oriented string; a hammer assembly including a hammer, a hammer butt, and a backstop portion, the backstop portion coupled to the hammer butt and extending therefrom; a jack member, the jack member including a first jack member end; a repetition spring coupled to the hammer assembly and coupled to the jack member; and an engagement member including an elastic member and an outer skin, the elastic member wrapped under compression with the outer skin, the engagement member coupled to the hammer butt and so oriented to physically engage with the first jack member end during one or more portions of travel by the first jack member. In addition to the foregoing, other method aspects are described in the claims, drawings, and text forming a part of the present disclosure.

6 Claims, 9 Drawing Sheets

(56) References Cited

U.S. PATENT DOCUMENTS

| | | | | | |
|---|---|---|---|---|---|
| 1,656,548 | A * | 1/1928 | Waggett | ..... | 84/241 |
| 4,896,577 | A * | 1/1990 | Trivelas et al. | ..... | 84/240 |
| 4,953,433 | A * | 9/1990 | Fandrich et al. | ..... | 84/239 |
| 5,042,354 | A * | 8/1991 | Trivelas et al. | ..... | 84/240 |
| 5,123,321 | A * | 6/1992 | Caught | ..... | 84/242 |
| 2012/0180614 | A1 * | 7/2012 | Fujii | ..... | 84/242 |
| 2014/0013922 | A1 * | 1/2014 | Fandrich | ..... | 84/242 |

* cited by examiner

ENHANCED VERTICAL PIANO ACTION SYSTEM AND METHOD

CROSS-REFERENCE TO RELATED APPLICATIONS

The present application is related to and/or claims the benefit of the earliest available effective filing date(s) from the following listed application(s) (the "Priority Applications"), if any, listed below (e.g., claims earliest available priority dates for other than provisional patent applications or claims benefits under 35 USC §119(e) for provisional patent applications, for any and all parent, grandparent, great-grandparent, etc. applications of the Priority Application(s)). In addition, the present application is related to the "Related Applications," if any, listed below.

PRIORITY APPLICATION(S)

The present application claims benefit of priority of U.S. Provisional Patent Application No. 61/669,835, entitled ENHANCED VERTICAL PIANO ACTION SYSTEM, naming Darrell G. Fandrich as inventor, filed 10 Jul. 2012, which was filed within the twelve months preceding the filing date of the present application or is an application of which a currently co-pending priority application is entitled to the benefit of the filing date.

RELATED APPLICATION(S)

None.

If the listings of applications provided above are inconsistent with the listings provided via an ADS, it is the intent of the Applicant to claim priority to each application that appears in the Priority Applications section of the ADS and to each application that appears in the Priority Applications section of this application.

All subject matter of the Priority Applications and the Related Applications and of any and all parent, grandparent, great-grandparent, etc. applications of the Priority Applications and the Related Applications, including any priority claims, is incorporated herein by reference to the extent such subject matter is not inconsistent herewith.

If an Application Data Sheet (ADS) has been filed on the filing date of this application, it is incorporated by reference herein. Any applications claimed on the ADS for priority under 35 U.S.C. §§119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

SUMMARY

In one aspect, a vertical piano includes, but is not limited to a vertical piano action including: a substantially vertically oriented string; a hammer assembly including a hammer, a hammer butt, and a backstop portion, the hammer coupled to the hammer butt and so oriented for striking the substantially vertically oriented string, the backstop portion coupled to the hammer butt and extending therefrom; a jack member, the jack member including a first jack member end; a repetition spring coupled to the hammer assembly and coupled to the jack member, the repetition spring extending therebetween; and an engagement member including an elastic member and an outer skin, the elastic member wrapped under compression with the outer skin, the engagement member coupled to the hammer butt and so oriented to physically engage with the first jack member end during one or more portions of travel by the first jack member.

In addition to the foregoing, other vertical piano aspects are described in the claims, drawings, and text forming a part of the disclosure set forth herein. In one aspect, a vertical piano includes, but is not limited to a vertical piano action including: a substantially vertically oriented string; a hammer assembly including a hammer, a hammer butt, and a backstop portion, the hammer coupled to the hammer butt and so oriented for striking the substantially vertically oriented string, the backstop portion coupled to the hammer butt and extending therefrom; an engagement member coupled to the hammer butt; a jack member, the jack member including a first jack member end, the first jack member end with a contoured surface so shaped without having a substantially 90 degree angled corner, the jack member so positioned to engage the first jack member end with the engagement member during one or more portions of travel by the jack member including the jack member so positioned to engage the contoured surface of the first jack member end with the engagement member so that the engagement member engages with other than a substantially 90 degree angled corner of the first jack member end at least during substantially initial re-engagement of the jack member with the engagement member after the hammer strikes the substantially vertically oriented string; and a repetition spring coupled to the hammer assembly and coupled to the jack member, the repetition spring extending therebetween.

In one aspect, a vertical piano action includes, but is not limited to, a striking means for striking a substantially vertically oriented string; a hammer butt engagement means for receiving a jack member to engage the jack member with a hammer butt; and a jack engagement means portion of the jack member for engaging with the hammer butt engagement means, the jack engagement means portion of the jack member for engagement with the hammer butt engagement means by using other than a substantially 90 degree angled corner at least during substantially initial re-engagement of the jack engagement means portion of the jack member with the hammer butt engagement means after the striking means strikes the substantially vertically oriented string.

In addition to the foregoing, various other aspects are set forth and described in the teachings such as text (e.g., claims and/or detailed description) and/or drawings of the present disclosure. The foregoing is a summary and thus may contain simplifications, generalizations, inclusions, and/or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

BRIEF DESCRIPTION OF THE FIGURES

For a more complete understanding of embodiments, reference now is made to the following descriptions taken in connection with the accompanying drawings. The use of the same symbols in different drawings typically indicates similar or identical items, unless context dictates otherwise.

With reference now to the figures, shown are one or more examples of enhanced vertical piano action systems and/or methods that may provide context, for instance, in introducing one or more processes and/or devices described herein.

DETAILED DESCRIPTION

An enhanced vertical piano action system introduced herein includes aspects to gain a more desirable elastic feel common to the touch of grand piano actions rather than that commonly experienced with vertical piano actions. Also, although the enhanced vertical piano action makes use of repetition springs, it includes aspects that allow for re-engagement of jack with hammer butt or of jack with knuckle after string strike with key return responsiveness similar to grand piano actions with their greater return force during jack re-engagement than found with conventional repetition-spring-containing vertical actions.

Aspects addressing a more desirable elastic feel include use of a knuckle (versions thereof similar to that found on grand pianos) on each hammer butt for engaging each jack to furnish elastic touch more closely in line with grand piano actions.

Figure 5:
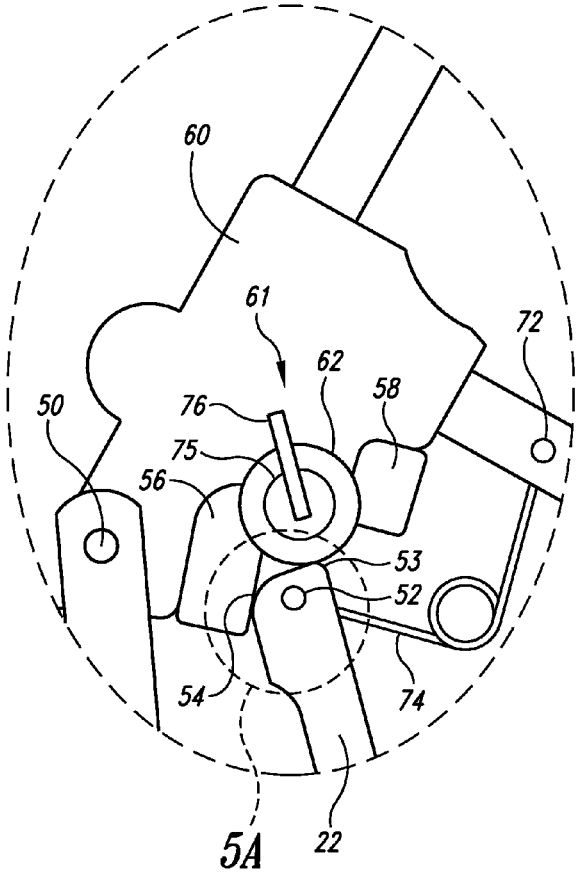
FIG. 5 is an enlarged side elevation view of portions of the first implementation of the enhanced action depicted in FIG. 1.

Regarding aspects addressing key return force during jack re-engagement, it has only been in the relatively recent past that some piano actions for vertical pianos (known also as "upright pianos") have incorporated a repetition spring for each piano key. Repletion springs can come in various versions such as torsion springs or compression springs. An example of a torsion spring implementation is shown with repetition spring 74 shown in the detailed view of FIG. 5 coupled between jack end 52 (shown engaging knuckle 61 (e.g. engagement member, hammer butt engagement means, etc.) coupled to hammer butt 60) and backstop portion 72 (extending from hammer butt 60). Alternative implementations of repetition springs include use of a compression spring (not shown) adjustably mounted between jack end 52 and a pilot attached to a threaded shaft through backstop portion 72 extending from hammer butt 60. These efforts in using repetition springs sought in part to simulate in a general sense in these vertical piano actions how the force of gravity acts at least in part on components of actions found in grand pianos.

The efficiency of repetition springs is such that it interrupts the opposed forces of hammer return springs and player end weighted keys only enough for the re-engagement of jack with hammer butt (or with knuckle in the case of versions of the enhanced vertical piano action system), after which the effect of the repetition spring is essentially nil. This effective absence of separation force allows a strong hammer return spring to react with key weight and inertia to keep jack in intimate contact with hammer butt (with knuckle for some versions of the enhanced vertical piano action system) during hammer return. It is this contact that eliminates dynamic lost motion that plagues vertical piano action not having repetition springs with a loose disjointed feel during various types of repeated play.

Since grand pianos and their actions tend to be preferred by a number of pianists, vertical pianos having actions with repetition springs simulating some aspects of grand piano actions have gained a following amongst a number of pianists. Yet, despite this welcomed use of repetition springs in vertical piano actions to simulate some aspects of grand piano actions, use of repetition springs in vertical piano actions have strayed from imitating other aspects of grand piano actions, namely, aspects having to do with key return force during jack re-engagement.

As introduced and described further herein, these conventional repetition-spring-containing vertical actions have been discovered by applicant to have a key return force used during jack re-engagement with hammer butt for repeated key play that is much lower than key return force during jack re-engagement with knuckle of grand piano actions and also much lower than the key return force during jack re-engagement with hammer butt for versions of vertical piano actions that do not contain repetition springs. Thus, in aspects that are affected by key return force during jack re-engagement, conventional repetition-spring-containing vertical piano actions can be less like grand piano actions than conventional vertical piano actions are that do not have repetition springs.

In general, piano actions have either a knuckle (found with grand pianos) or a hammer butt (found with vertical pianos and most 19th century grand pianos) for jack engagement. Vertical piano actions that do not use repetition springs and early grand piano actions reset, or re-engage, for repeated play by balancing the key/jack assembly so that it falls toward the rest position considerably faster than the hammer assembly to quickly make space for the jack to re-engage the hammer butt. The force to move the jack back to the engaged position is provided by a small spring (jack spring).

The balance of the modern grand piano action key/jack assembly is opposite that of these vertical and early grand piano actions. For modern grand piano actions, a strong spring provides the force to separate the key/jack and hammer assembles to make space for the jack to re-engage. A small spring then moves the jack back into re-engagement with the knuckle.

In contrast, the conventional repetition-spring-containing vertical action achieves re-engagement at least partially with a wedging or camming action. A single strong repetition spring forces the jack against the leather/felt covered inclined plane of the hammer butt to separate the parts and make space for the jack to re-engage. Unfortunately, difficulties arise during re-engagement with the conventional repetition-spring-containing vertical piano actions. During re-engagement, the edge of the jack impresses itself into the relatively soft and compliant leather of the butt, creating drag which limits the force available for key return.

As further explanation, for each piano key, typical grand piano actions press their jack against their knuckle and conventional without-repetition-spring vertical piano actions press their jack against their hammer butt both with 5-10 grams force. In contrast, conventional repetition-spring-containing vertical actions exert 40-50 grams force with their jack against their hammer butt. With this large contact force found with conventional repetition-spring-containing vertical piano actions, the undesirable effects of having a typical re-engagement jack surface with substantially a 90 degree corner as part of a surface with which to contact the hammer butt during re-engagement is pronounced. Since the enhanced vertical piano action system also uses repetition springs, it too has 40-50 grams force against either its knuckle (in the first implementation shown for instance in FIGS. 1-6 and 7-9) or against its hammer butt (in the second alternative implementation shown in FIG. 6A), but as discussed below employs aspects that mitigate these large contact forces that are not employed by conventional repetition-spring-containing vertical piano actions.

To illustrate these difficulties with effects of contact forces upon key return force, grand piano actions typically produce 30-40 grams of up-force at the key end during the re-engagement portion of the key return. In contrast, applicant has discovered that conventional repetition-spring-containing vertical piano actions typically produce only 18-22 grams of key return force during re-engagement.

Although the enhanced vertical piano action system uses repetition springs, by incorporating aspects further described below, 30-35 grams of key return force during jack re-engagement can be produced. Also, if desired, lower forces of between 25-30 grams of key return force during jack re-engagement can be produced with alternative versions of the enhanced vertical piano action system. For comparison purposes 25-30 grams of key return force during jack re-engagement is typical for conventional vertical piano actions that do not have repetition springs. This relatively large key return force during jack re-engagement provided by the enhanced vertical piano action system (for instance, 30-35 grams for the enhanced vertical piano action compared with 18-22 grams for conventional repetition-spring-containing vertical piano actions) is sufficient to overcome difficulties associated with key return force during jack re-engagement by conventional repetition-spring-containing vertical piano actions.

As described above and further herein, the enhanced vertical piano action system introduces approaches that can provide key return force during jack re-engagement at a level comparable to that of grand piano actions to recapture simulated aspects thereof hitherto lost by conventional repetition-spring-containing vertical piano actions while also using repetition springs to retain those aspects of grand piano actions already closely approximated by conventional repetition-spring-containing vertical piano actions.

Figure 6:
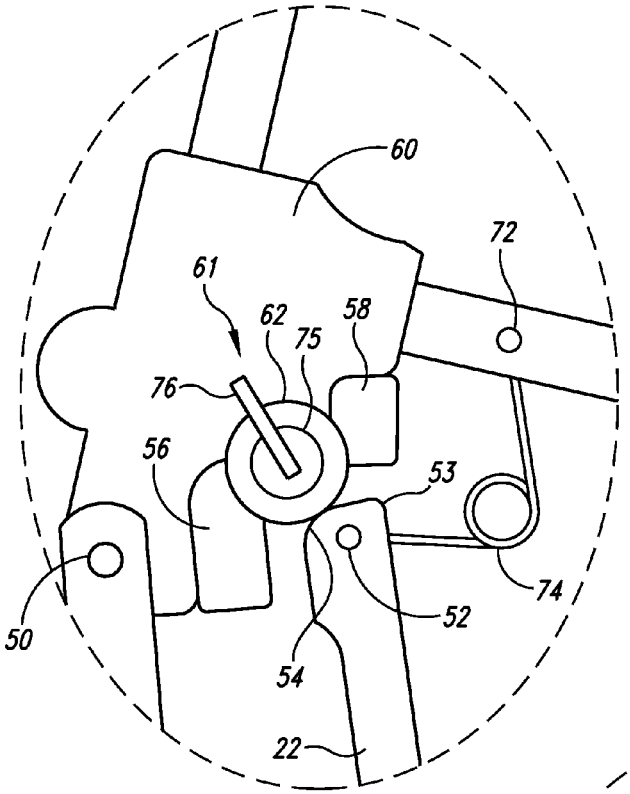
FIG. 6 is an enlarged side elevation view of portions of the first implementation of the enhanced action depicted in FIG. 2.
Figure 6A:
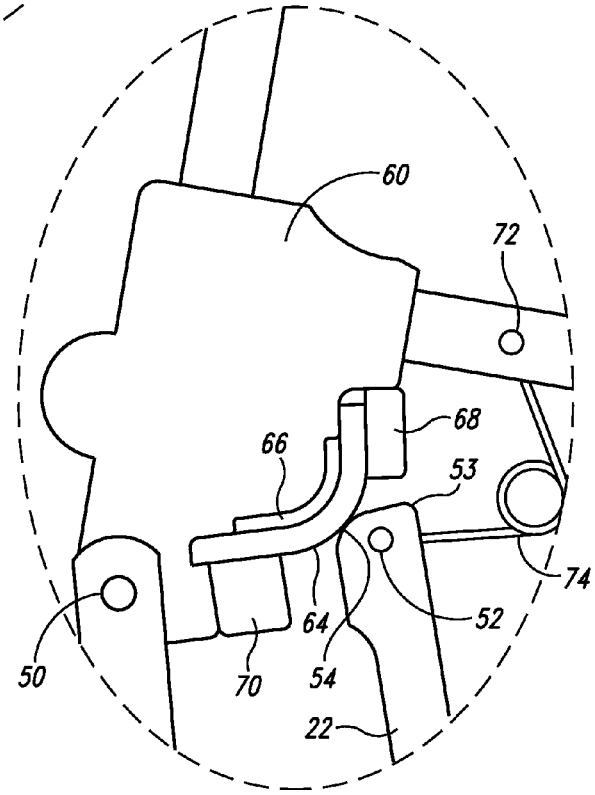
FIG. 6A is an enlarged side elevation view showing an alternative second implementation of the piano action having an alternative interface with the jack 22.
Figure 7:
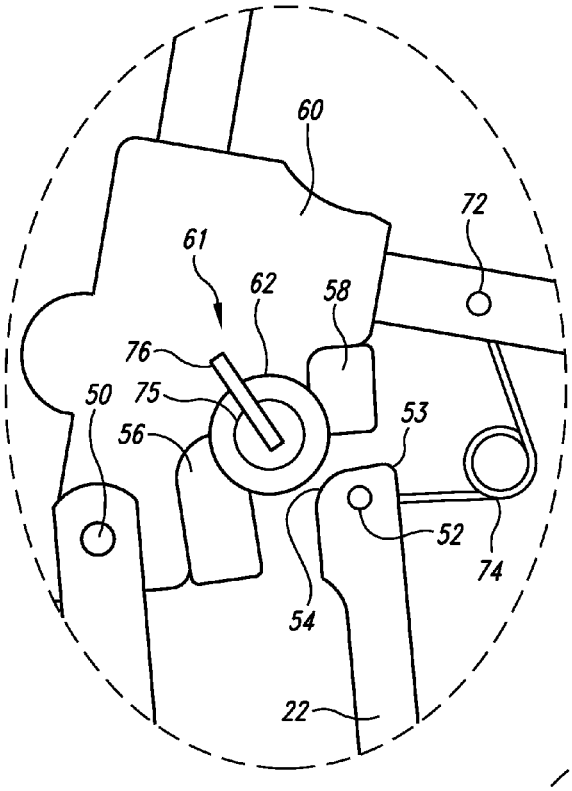
FIG. 7 is an enlarged side elevation view of portions of the first implementation of the enhanced action depicted in FIG. 3.

For instance, the enhanced vertical piano action system can include, for each piano key, contact surface area between jack and knuckle during jack re-engagement (shown in FIG. 8) or between jack and hammer butt (second implementation shown positioned in FIG. 6A before jack disengagement, but FIG. 6A shows positioning of jack 22 and hammer butt 60 and hammer butt leather 64 also as they are during jack re-engagement) greater than found with contact surface between jack and hammer butt during jack re-engagement of conventional vertical piano actions or between jack and knuckle during jack re-engagement of grand piano actions to allow for greater return key force during jack re-engagement than found in conventional repetition-spring-containing vertical actions.

Figure 1:
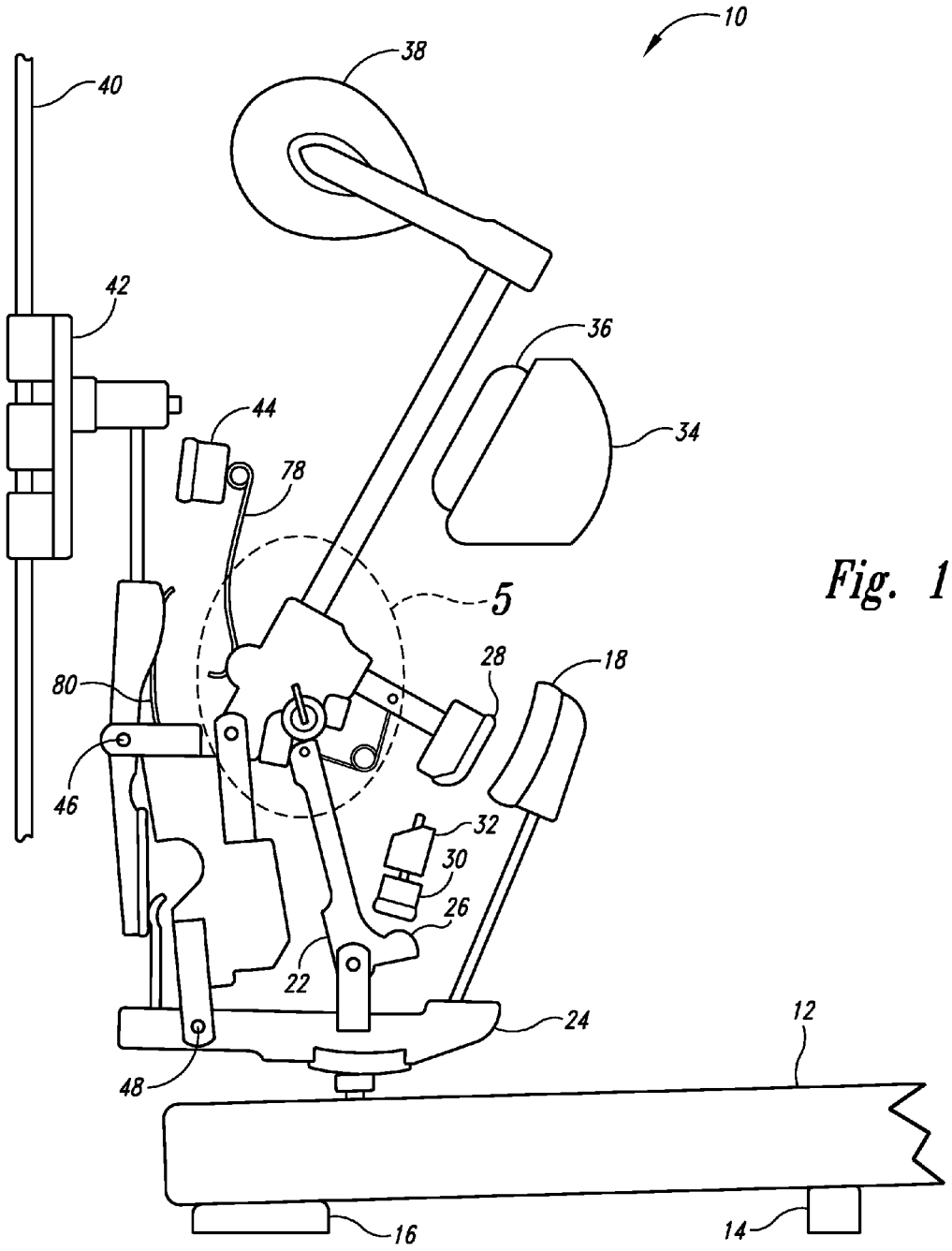
FIG. 1 is a side elevation view of portions of a first implementation of an enhanced vertical piano action system depicted as positioned with its corresponding piano key (not shown) fully up in its at-rest position.

Aspects of the enhanced vertical piano action system to increase this contact surface include implementations having unconventionally large radius of curvature for the edge of jack that engages knuckle (first implementation) or that engages butt (second implementation) during jack re-engagement. Other alternative shapes can be included with the enhanced vertical piano action system for this jack re-engagement contact surface. For instance, a variable radius associated with an ellipsis shape, or with a beveled edge, and so forth can be used for the jack re-engagement contact surface on the jack 22 to also achieve greater jack re-engagement contact surface area. A large jack re-engagement contact surface area can result in lowered frictional force between jack and knuckle (first implementation) or jack and butt (second implementation) during re-engagement for the enhanced vertical piano action system. This lower frictional force can in turn result in the relatively large jack re-engagement key return force of 30-35 grams for the enhanced vertical piano action system as further discussed above Aspects of an exemplary implementation of the enhanced vertical piano action system shown as piano action 10 are depicted in FIG. 1 and following. It is noted that many of the components shown of piano action 10 are also found in conventional vertical piano actions including those vertical piano actions containing repetition springs, but are briefly mentioned nonetheless to provide context. Also, although FIG. 1 and those figures following only illustrate piano action 10 for one piano key, one of ordinary skill will understand that what is shown for one piano key would be applicable to other or all piano keys of a vertical piano using piano action 10. It is also understood that a vertical piano is made up of other components that are not shown such as frame, bridge, sound board, damper, pedals, cabinet, etc. Although these other components have not been shown, one of ordinary skill would understand that these other components are typically included with vertical pianos that incorporate piano action 10 into their design.

To assist with further orienting the reader with depictions of piano action 10 found in the figures, this brief overview is provided. In general FIGS. 1-4 progressively depict piano action 10 in various phases of its movement including aspects included in subsequent figures, however, the figures thereafter focus even more on various aspects of jack 22 engagement with hammer butt 60 through either knuckle 61 (see FIG. 5) or hammer butt leather 64 (see FIG. 6A).

Figure 2:
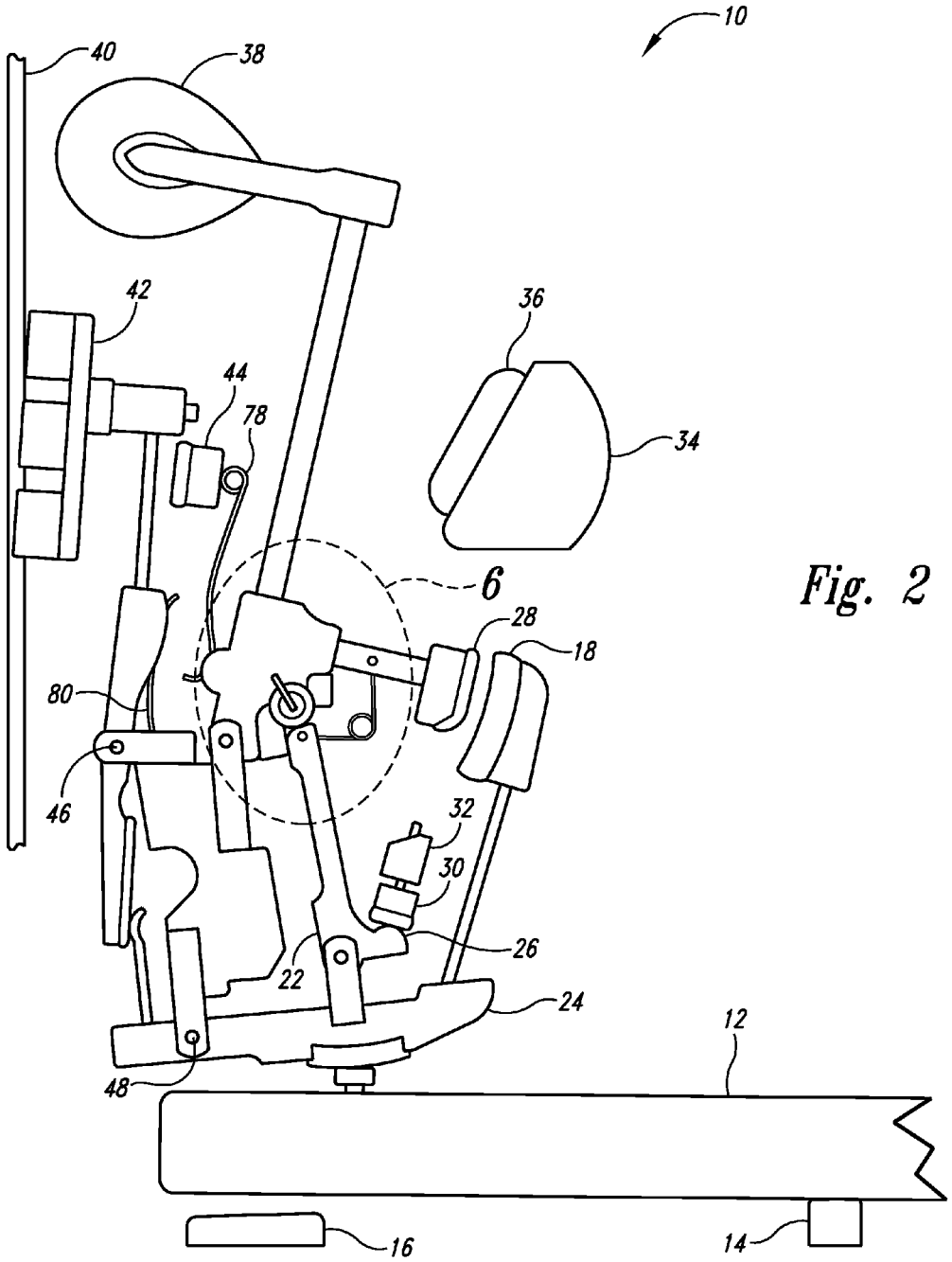
FIG. 2 is a side elevation view of portions of the first implementation of the enhanced vertical piano action system of FIG. 1 depicted as positioned with its piano key approximately one third down at the commencement of disengagement with the hammer before its string is struck.
Figure 3:
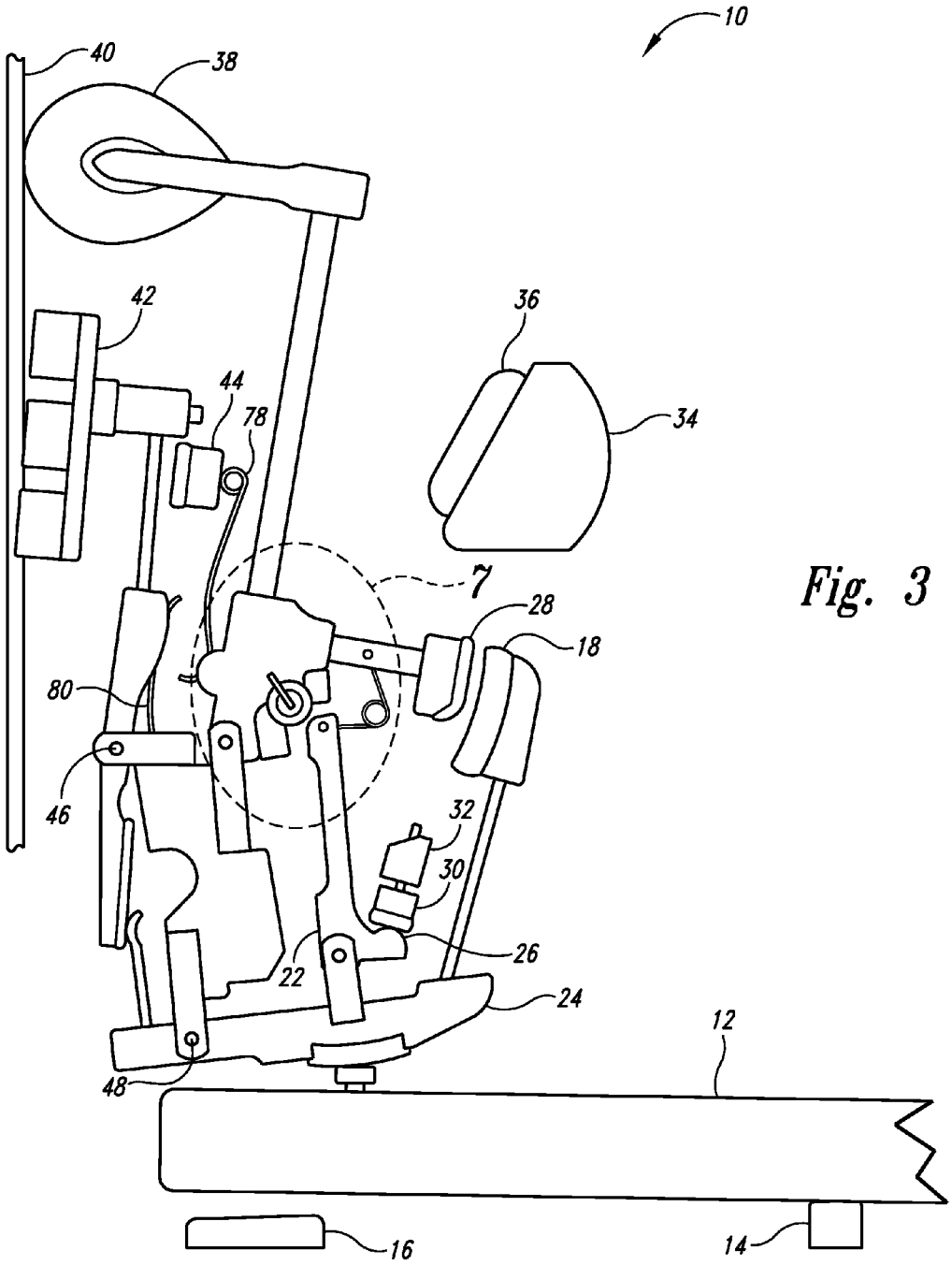
FIG. 3 is a side elevation view of portions of the first implementation of the enhanced vertical piano action system of FIG. 1 depicted as positioned with its piano key fully down as its string is being struck.
Figure 4:
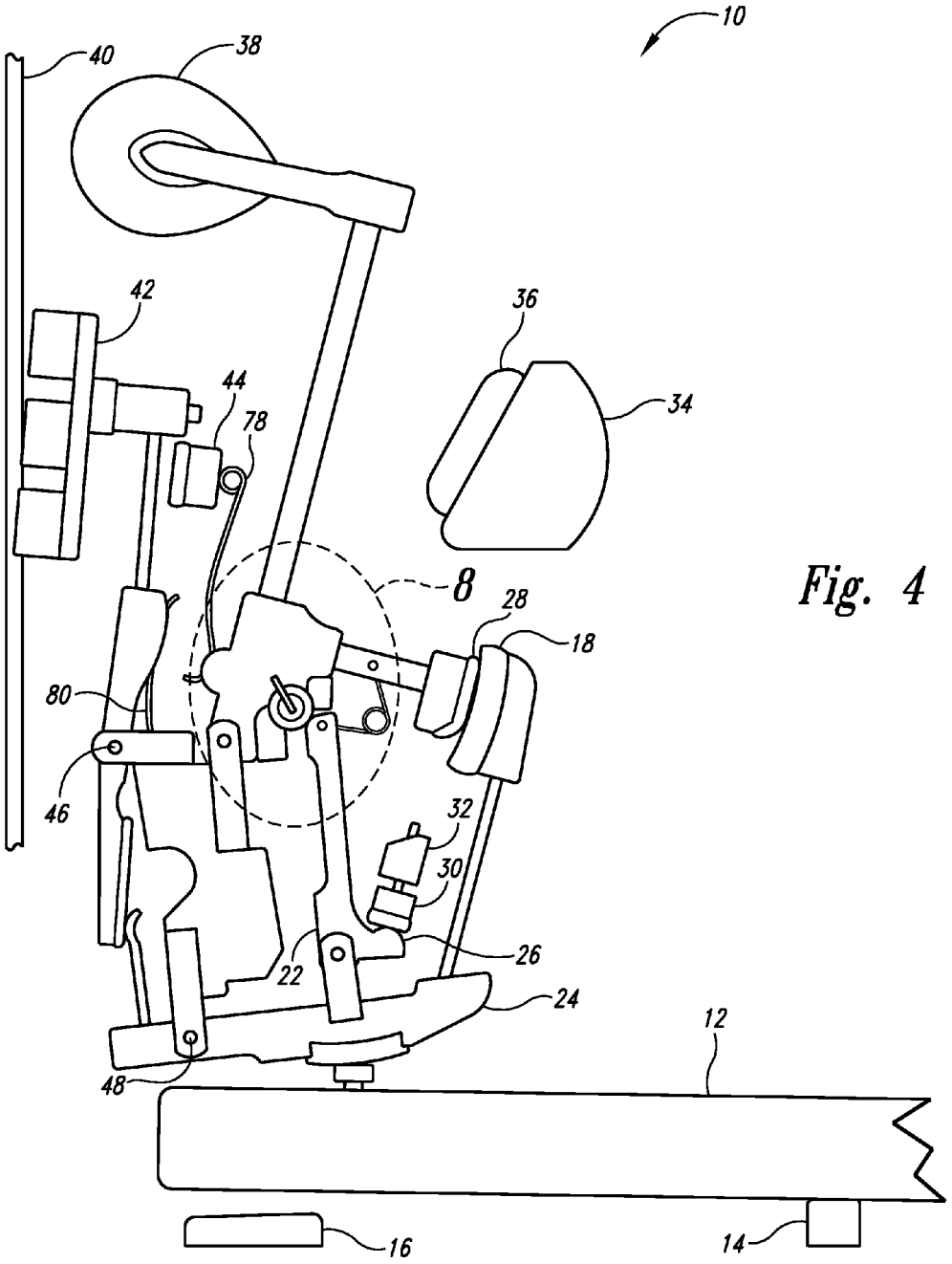
FIG. 4 is a side elevation view of portions of the first implementation of the enhanced vertical piano action system of FIG. 1 depicted as positioned with its piano key fully down with its string having been struck and its hammer having partially returned to the checked position.

In depicting progressive motion of piano action 10, FIG. 1 first shows piano action 10 positioned with piano key 12 (partially shown) fully up in at-rest position. FIG. 2 then depicts piano action 10 positioned with piano key 12 approximately two thirds down at the commencement of disengagement with hammer 38 (e.g. striking means, etc.) before string 40 is struck thereby. FIG. 3 subsequently depicts piano action 10 as positioned with piano key 12 fully down as string 40 is being struck by hammer 38. FIG. 4 follows-up by depicting piano action 10 positioned with piano key 12 fully down with string 40 having been struck and hammer 38 having partially returned to a checked position.

Figure 5A:
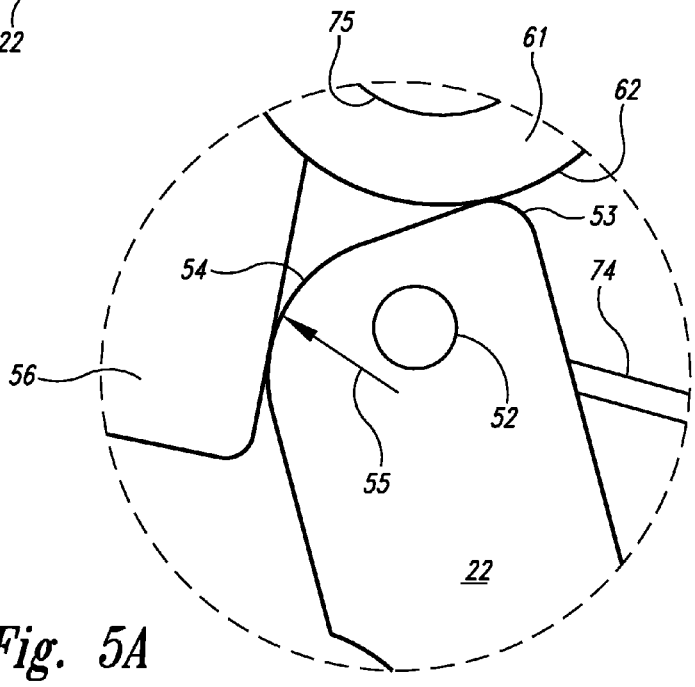
FIG. 5A is an enlarged side elevation view of a portion of FIG. 5 to facilitate illustration of curvature of the surface 55 allowing for larger contact surface area for the jack engaging edge 54.

FIGS. 5, 6, 7, and 8 are enlarged views depicting portions of FIGS. 1, 2, 3, and 4, respectively, to focus on aspects of engagement by jack end 52 (e.g. first jack member end, etc.) of jack 22 (e.g. jack member, etc.) with hammer butt 60 through knuckle 61. FIG. 5A enlarges on a portion of FIG. 5 to better show curvature of jack re-engagement surface 54 of jack end 52 of jack 22 that consequently provides relatively large contact surface area for re-engagement of jack 22. FIG. 6A shows an alternative second implementation of piano action 10 where hammer butt leather 64 is used instead of knuckle 61 to engage hammer butt 60 with jack end 52 of jack 22. FIGS. 10-14 are side elevation views depicting alternatively shaped end portions for jack end 52 of jack 22 regarding increasing surface area of engagement.

Referring now again to FIG. 1, FIG. 1 depicts piano action 10 as including piano key 12 (partially shown in FIG. 1), fulcrum 14 for piano key 12 to be positioned upon, pad 16 for one end of piano key 12 to rest upon, etc. Piano action 10 is illustrated in FIG. 1 to further include back check 18, jack 22, wippen 24, jack heel 26, back catcher 28, letoff button 30, letoff rail 32, hammer rest rail 34, rest rail cloth 36, hammer 38, string 40, damper 42, damper slap rail 44, damper lever assembly 46, wippen flange center 48, hammer return spring 78, and damper spring 80.

Figure 8:
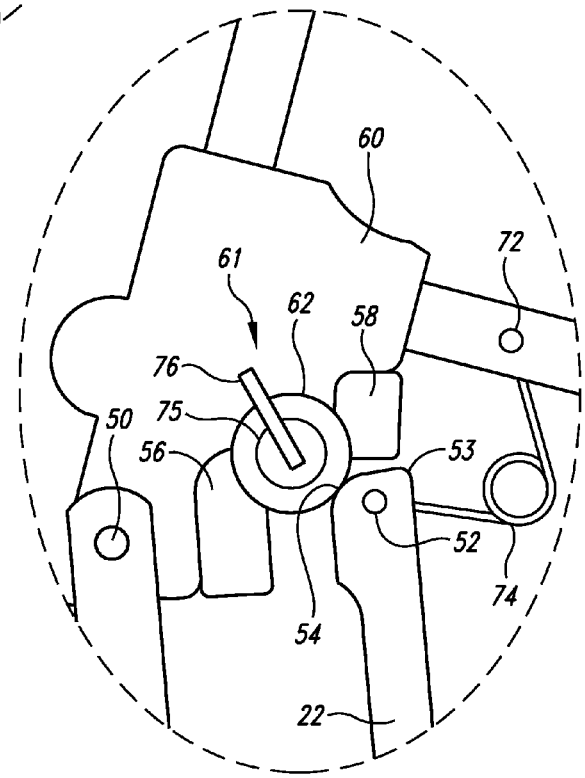
FIG. 8 is an enlarged side elevation view of portions of the first implementation of the enhanced action depicted in FIG. 4.

As depicted in FIGS. 1-4 of piano action 10, a note is played by rocking movement of key 12 on fulcrum 14 thereby raising jack 22 through elevation of wippen 24. Jack end 52 of jack 22 engages hammer butt 60 through knuckle 61 (called out in FIG. 5) or alternatively through hammer butt leather (see FIG. 6A) thereby rotating hammer butt 60 so that hammer 38 is set in motion toward the substantially vertically oriented string 40. As the motion continues, jack heel 26 of jack 22 approaches letoff button 30, adjustably mounted on letoff rail 32 (attached to basic structure). Upon contact with letoff button 30, continued motion of wippen 24 causes jack 22 to rotate (as shown progressively in FIGS. 1-3) causing jack end 52 to disengage from hammer butt 60 (shown in FIGS. 3 and 7 as being disengaged from knuckle 61 of hammer butt 60). This disengagement, also termed escapement, occurs just before hammer 38 hits string 40. Momentum causes hammer 38 to strike string 40 and rebound. Hammer return spring 78, attached to damper slap rail 44 (attached to basic structure), supplements this rebound. At some point, back catcher 28 of backstop portion 72 (e.g. a hammer assembly including herein hammer 38, hammer butt 60, and backstop portion 72, etc.) will contact back check 18 to stop hammer motion as shown in FIG. 4 with piano key 12 fully down and hammer 38 having partially returned to a checked position after striking string 40. Also, in this position, jack end 52 of jack 22 has started to again re-engage with hammer butt 60 such as with knuckle 61 as shown in FIG. 8. It is at this point of re-engagement that the key return forces are inadequate with conventional repetition-spring-containing vertical piano actions.

Referring now to FIGS. 5, 5A, 6, 7, and 8, these Figures focus on portions and positioning of such of piano action 10 also shown in FIGS. 1, 1, 2, 3, and 4, respectively. In FIGS. 5, 6, 7, and 8, piano action 10 is depicted to further include hammer butt flange center 50, jack end 52, back edge of jack 53, and jack re-engagement contact surface 54 (contacts either knuckle 61 of FIG. 8 or hammer butt leather 64 of FIG. 6A in re-engagement of jack), which has a radius of curvature 55 (shown in FIG. 5A) in which 1.25-1.5 mm is preferred, 1.5-2 mm is more preferred, >2 mm is preferred). FIGS. 5, 6, 7, and 8 also include hammer butt felt 56, jack block felt 58, hammer butt 60, knuckle (also known as "roller") 61, knuckle outer leather 62, repetition spring first end 72, repetition spring 74, inner portion of knuckle (felt) 75, and knuckle core (wood) 76. An alternative to knuckle 61 is shown in FIG. 6A to include hammer butt leather 64, hammer butt felt backing 66, jack block felt 68, hammer butt felt 70.

As shown in FIG. 8, jack re-engagement contact surface 54 (e.g. contoured surface, jack engagement means portion of the jack member, etc.) has a contoured shape without any substantially 90 degree corners, which consequently provides greater surface area (compared with less surface area available if a substantially 90 degree corner was included) for jack re-engagement contact surface 54 of jack 22 to contact knuckle outer leather 62 of knuckle 61 during re-engagement of jack 22 with knuckle 61 after hammer strike of string 40. With this greater surface area provided by the shape of jack re-engagement contact surface 54, less friction is present (compared with more friction present if a substantially 90 degree corner was included) between jack re-engagement contact surface 54 of jack 22 and knuckle outer leather 62 of knuckle 61. With this less friction present, greater key return force can be available during re-engagement of jack 22 with knuckle 61. Travel of jack 22 during re-engagement can amount to up to about one-third of overall travel of jack 22 back to its starting point shown in FIG. 1 so this positive effect on increased key return up force can be significant. Alternatively, similar to that described above for knuckle 61, in FIG. 6A with jack re-engagement contact surface 54 (having the same contoured shape as shown in FIG. 8) shown contacting hammer butt leather 64 wherein greater key return force can be available during jack re-engagement with hammer butt leather 64 due to less friction therebetween further due to the contoured shape not having any substantially 90 degree corners.

Figure 10:
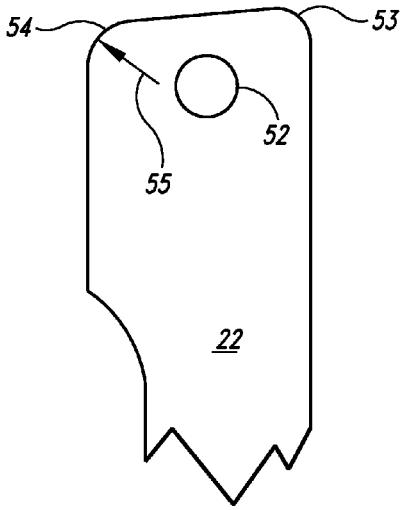
FIGS. 10-14 are side elevation views depicting alternatively shaped end portions of jack 22.
Figure 11:
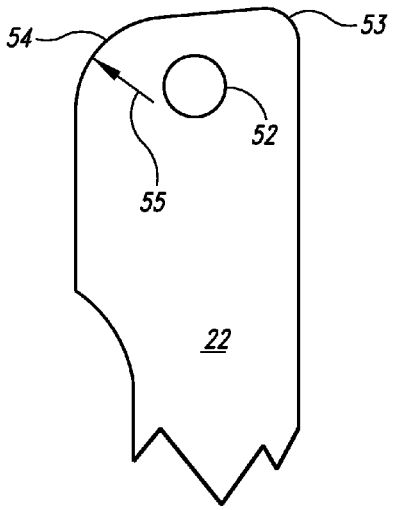
Figure 12:
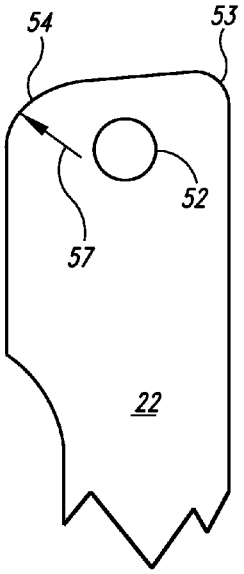
Figure 13:
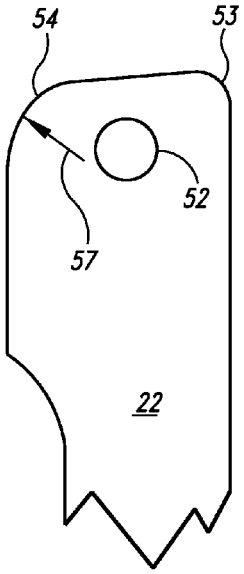
Figure 14:
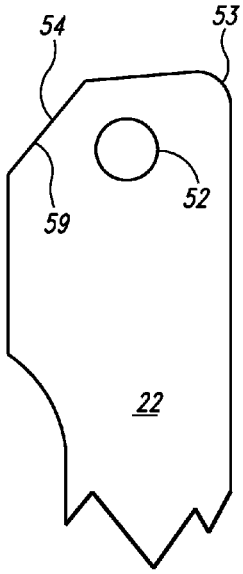

Referring to FIGS. 10-14, FIGS. 10-14 are side elevation views depicting alternatively shaped versions of jack re-engagement contact surface 54 of jack 22. FIGS. 10 and 11 depict the jack re-engagement contact surface 54 being shaped with radius of curvature 55 of various sizes. FIGS. 12 and 13 depict the jack re-engagement contact surface 54 to have an elliptical shape having variable ellipse radius 57 of various sizes. FIG. 14 depicts the jack re-engagement contact surface 54 as a beveled edge 59 where the jack re-engagement contact surface 54 can have corners but those corners have angles much larger than 90 degrees such as the two corners show each having corners with angles substantially each of 135 degrees. These approaches shown in FIGS. 10-14 all seek to continually maintain substantial cross-section area of the jack re-engagement contact surface 54 that comes in contact with the knuckle outer leather 62 of knuckle 61 or the hammer butt leather 64 of hammer butt 60 throughout re-engagement of the jack 22 therewith. This continually maintained substantial cross-sectional area throughout component motion of re-engagement is in contrast with a conventional repetition-spring-containing vertical piano action that has a jack that re-engages its hammer butt with a jack surface having substantially a 90 degree angled corner therein.

Figure 9:
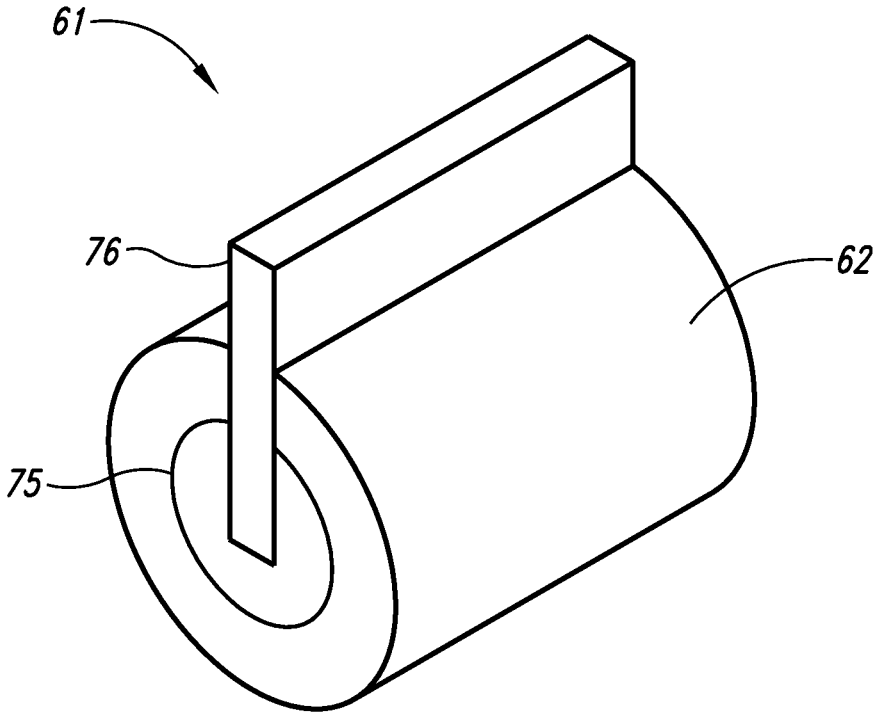
FIG. 9 is a perspective view of the version of the knuckle depicted in FIG. 1.

Mention has been made throughout about the knuckle 61 (e.g. engagement member, etc.) as shown in detail, for instance, in FIG. 9 with its wooden knuckle core 76 coupled with hammer butt 60 to secure the knuckle 61 to the hammer butt. Although knuckles are used extensively with grand piano actions, applicant is unaware of any vertical piano actions that employ use of knuckles. The knuckle 61 (e.g. cylindrically shaped knuckle member, etc.) shown, for instance, in FIGS. 8 and 9 has a cylindrical shape with cylindrical shaped inner felt portion 75 (e.g. elastic member, the elastic member including a felt material, etc.) with knuckle outer leather 62 (e.g. outer skin, the outer skin including a leather material, etc.) circumferentially extending therearound (e.g. elastic member being wrapped under compression with the outer skin, etc.) and with wooden knuckle core 76 extending thereinto each. As is known with grand piano actions, the combination of inner felt portion 75 and knuckle outer leather 62 provides a resiliency not found with the hammer butt leather 64. Also as can be seen by comparing, for instance, knuckle 61 with hammer butt leather 64, the knuckle can have a much smaller radius of curvature than the hammer butter leather. These resiliency and radius of curvature aspects gives the knuckle advantages at times of engagement, disengagement, re-engagement of jack 22 with knuckle 61. Throughout travel of jack 22 during engagement of the jack with knuckle 61, the resiliency of the knuckle adds a certain springiness in the feel of how key 12 is played. At time of disengagement of jack 22 with knuckle 61, the short radius of curvature of the knuckle allows for the jack to be disengaged from the knuckle with less overall travel of jack 22 and piano action 10 involved. Also right at time of disengagement the shape and resiliency of knuckle 61 builds up a certain resistance to disengagement so that a tactile sensation indicating position of action travel can be sensed through key 12 aiding in tactical feedback involved with piano play. At moment of re-engagement of jack 22 with knuckle 61, the short radius of the knuckle allows for a short distance of travel of the action before re-engagement occurs. With short travel of action components for disengagement and re-engagement of jack 22 with knuckle 61, piano action 10 is able to facilitate an increased speed of play not found with conventional vertical piano actions.

In the detailed description contained herein, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. For instance, reference is made to natural materials, such as leather and felt materials, being used, but in alternative implementations other non-natural materials, such as synthetic type materials, may be used as dictated by design choice of one of ordinary skill.

The present application may use formal outline headings for clarity of presentation. However, it is to be understood that the outline headings are for presentation purposes, and that different types of subject matter may be discussed throughout the application (e.g., device(s)/structure(s) may be described under process(es)/operations heading(s) and/or process(es)/operations may be discussed under structure(s)/process(es) headings; and/or descriptions of single topics may span two or more topic headings). Hence, the use of the formal outline headings is not intended to be in any way limiting.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A vertical piano comprising:

a vertical piano action including: a substantially vertically oriented string; a hammer assembly including a hammer, a hammer butt, and a backstop portion, the hammer coupled to the hammer butt and so oriented for striking the substantially vertically oriented string, the backstop portion coupled to the hammer butt and extending therefrom;

a jack member, the jack member including a first jack member end;

a repetition spring coupled to the hammer assembly and coupled to the jack member, the repetition spring extending therebetween;

and an engagement member including an elastic member and an outer skin, the elastic member wrapped under compression with the outer skin, the engagement member coupled to the hammer butt and so oriented to physically engage with the first jack member end during one or more portions of travel by the first jack member.

2. The vertical piano of claim 1 wherein the repetition spring coupled to the hammer assembly and coupled to the jack member, the repetition spring extending therebetween comprises:

the repetition spring configured as one of the following: a compression spring or a torsion spring.

3. The vertical piano of claim 1 wherein the engagement member including an elastic member and an outer skin, the elastic member wrapped under compression with the outer skin, the engagement member coupled to the hammer butt and so oriented to physically engage with the first jack member end during one or more portions of travel by the first jack member comprises:

the elastic member including a felt material; and the outer skin including a leather material.

4. The vertical piano of claim 1 wherein the engagement member including an elastic member and an outer skin, the elastic member wrapped under compression with the outer skin, the engagement member coupled to the hammer butt and so oriented to physically engage with the first jack member end during one or more portions of travel by the first jack member comprises:

the elastic member including a cylindrically shaped knuckle member.

5. A vertical piano action comprising:

a substantially vertically oriented string;

a hammer assembly including a hammer, a hammer butt, and a backstop portion, the hammer coupled to the hammer butt and so oriented for striking the substantially vertically oriented string, the backstop portion coupled to the hammer butt and extending therefrom;

a jack member, the jack member including a first jack member end;

a repetition spring coupled to the hammer assembly and coupled to the jack member, the repetition spring extending therebetween; and an engagement member including an elastic member and an outer skin, the elastic member wrapped under compression with the outer skin, the engagement member coupled to the hammer butt and so oriented to physically engage with the first jack member end during one or more portions of travel by the first jack member.

6. The vertical piano action of claim 5 wherein the engagement member including an elastic member and an outer skin, the elastic member wrapped under compression with the outer skin, the engagement member coupled to the hammer butt and so oriented to physically engage with the first jack member end during one or more portions of travel by the first jack member comprises:

the elastic member including a cylindrically shaped knuckle member.

* * * * *